United States Patent [19]

Hardy

[11] Patent Number: 4,915,668

[45] Date of Patent: Apr. 10, 1990

[54] BOAT TUNNEL APPARATUS AND METHOD

[76] Inventor: Charles R. Hardy, Rte. 2, High Rd., No. 79, San Marcos, Tex. 78666

[21] Appl. No.: 235,491

[22] Filed: Aug. 24, 1988

[51] Int. Cl.[4] ..... B63H 5/16

[52] U.S. Cl. ..... 440/69; 114/288

[58] Field of Search ..... 114/288, 56; 440/61, 440/66, 68, 69, 70, 88

[56] References Cited

U.S. PATENT DOCUMENTS

| | | | |
|---|---|---|---|
| 2,656,812 | 10/1953 | Kiekhaefer | 440/88 X |
| 2,674,219 | 4/1954 | Kiekhaefer | 440/61 |
| 3,469,557 | 9/1969 | Wollard | 440/69 |
| 3,768,432 | 10/1973 | Spaulding | 440/66 |
| 4,713,028 | 12/1987 | Duff | 440/69 |

FOREIGN PATENT DOCUMENTS

| | | | |
|---|---|---|---|
| 961095 | 5/1963 | United Kingdom | 440/69 |

*Primary Examiner*—Sherman D. Basinger
*Attorney, Agent, or Firm*—J. Nevin Shaffer, Jr.

[57] ABSTRACT

A boat tunnel system apparatus and method for providing shallow operation of a boat when utilizing standard outboard motors. A convex tunnel having a forward end, a convex center section, and a rearward end that exits the stern of a boat above the water line ensures that water adheres to the convex tunnel as the boat moves forward through the water thereby causing water to exit the stern of the boat above the normal water line. As the boat gains speed, water exits higher and higher above the normal water line and, in conjunction with the convex tunnel, a movable motor with propeller attached can be lifted into the solid water stream exiting the stern of the boat. As the boat reaches a plane position, a solid stream of water is provided so far above the normal water line of the boat that the propeller and water intakes of a motor can be raised above the water line and, in fact, raised above the hull of the boat. As a result, the boat utilizing the boat tunnel system of the present invention in conjunction with a movable motor, can be operated in extremely shallow waters, limited only by the draft of the boat itself.

8 Claims, 5 Drawing Sheets

BOAT TUNNEL APPARATUS AND METHOD

BACKGROUND OF THE INVENTION

This invention relates to a boat tunnel for enabling boats to operate in shallow water.

The idea of providing boats of special design to travel in shallow water has been known for some time. Air cushion boats, hydrofoils, fan driven boats and water driven boats all have as their purpose the ability of a boat to travel in extremely shallow water. Each one of these particular designs demonstrates concern for the normal operation of a motor with a propeller as a means for driving a boat through the water. The concern, of course, is that the shallowness of water that the boat may operate in with a conventional motor driven propeller is limited by the depth of the water into which the propeller is placed. The propeller must be placed, in the typical arrangement, beneath the hull of the boat in order for proper operation to take place. This is so because the propeller needs to be in water in order to provide propulsion and the water cooling intakes of the standard motor must be in water in order to cool the motor. It is known that, at high speeds, a "rooster tail" is thrown up and wash from the boat itself gathers behind the stern of the boat so that the propeller may be tilted and raised some small amount without reducing the effectiveness of the motor and the forward motion of the boat too much.

A drawback to the shallow water boat designs known in the art, however, is that they typically can not be used in association with a standard outboard motor and motorized propeller. That is, the standard motor and motor driven propeller must remain in a solid stream of water in order to be effectively used. Thus, there is a need in the art for providing a means whereby a standard outboard motor may be utilized on a boat traveling through shallow water. It, therefore, is an object of this invention to provide a boat tunnel system that directs water above the water line so that a standard propeller may be raised above the hull of a boat and still provide propulsion so that the boat can go into very shallow water.

SHORT STATEMENT OF THE INVENTION

Accordingly, the boat tunnel system for a motorized propeller to be operated above the hull of a boat includes a boat with a hull, a bow and a stern. A convex tunnel is formed in the hull of the boat and exits at the stern of the boat above the water line. As a result, as the boat travels through the water, the water adheres to the convex surface of the tunnel and is drawn upward in the tunnel so that it exits the stern above the water line. A movable motor, with a propeller, is attached to the stern so that as the boat picks up speed and the water begins to exit the convex tunnel, the propeller may be raised. Ultimately, the propeller can be raised above the water line of the hull while still remaining in a solid water stream.

The convex tunnel consists of a forward end that commences at a approximately the mid-point of, and flush with, the hull. A convex center section of the tunnel curves away from the hull upwardly until it ends in a rearward end of the tunnel that terminates in the stern of the boat above the water line. As a result, the combination of the convex tunnel and the movable motorized propeller enables the boat to be driven in extremely shallow water. The only limitation being the draft of the boat itself, because the propeller is, in fact, raised above the hull or bottom of the boat.

BRIEF DESCRIPTION OF THE DRAWINGS

Other objects, features, and advantages of the present invention will become more fully apparent from the following detailed description of the preferred embodiment, the appended claims, and the accompanying drawings in which:

DETAILED DESCRIPTION OF THE PREFERRED EMBODIMENT

The preferred embodiment of the present invention is illustrated by way of example in FIGS. 1–5.

Figure 1:
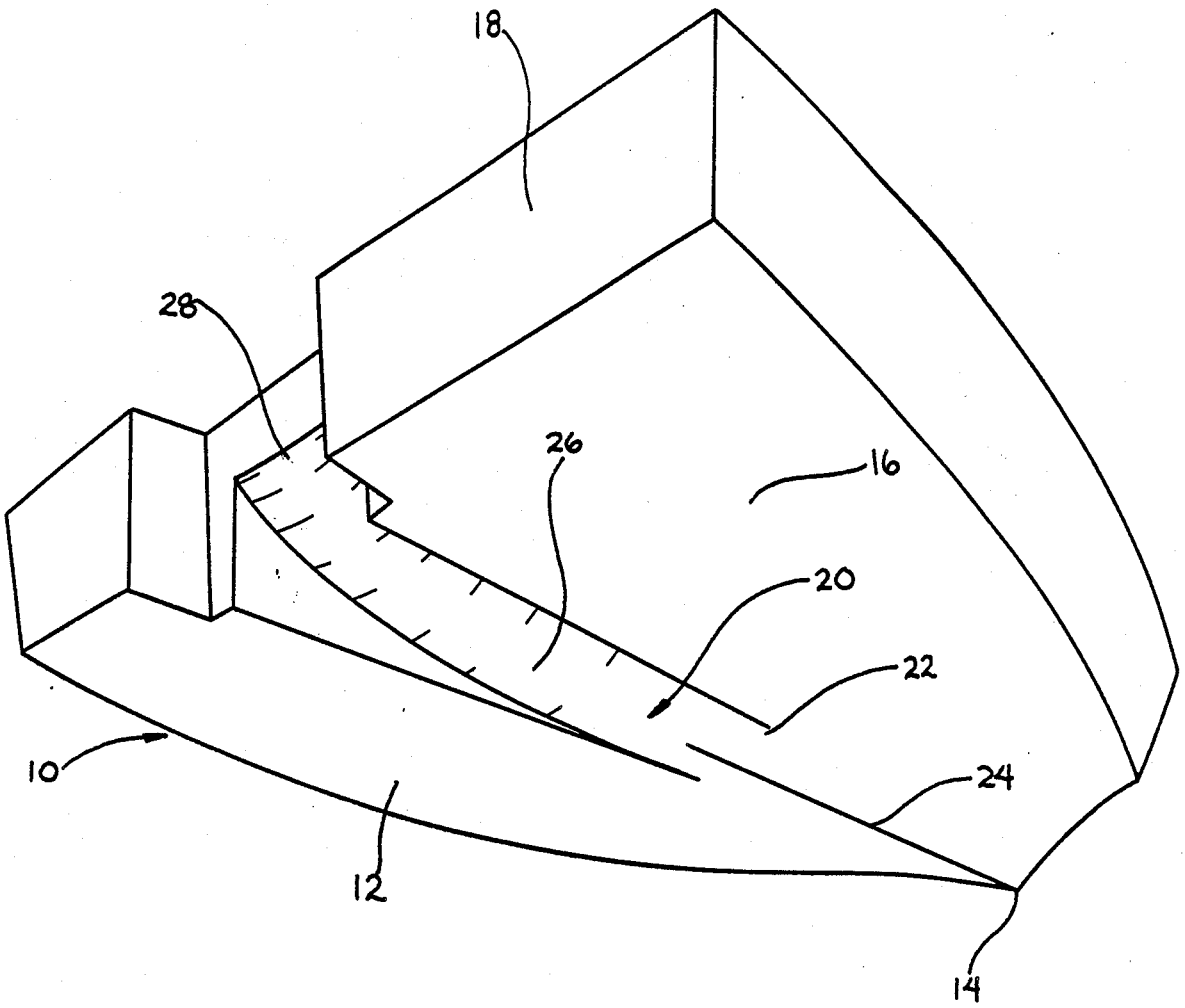
FIG 1 is a plan view of a preferred embodiment of the boat tunnel system of the present invention showing the bottom or hull of a boat.

With specific reference to FIG. 1, a boat tunnel system 10 includes a boat 12 with a bow 14, a hull 16, and a stern 18. Convex tunnel 20 is formed in hull 16 and is comprised of a forward end 22 commencing at a midpoint 24, and flush with, of hull 16. Convex center section 26 curves away from said hull and terminates in rearward end 28 that exits stern 18 above water line 30 as more clearly shown in FIG. 5*a*.

Figure 2:
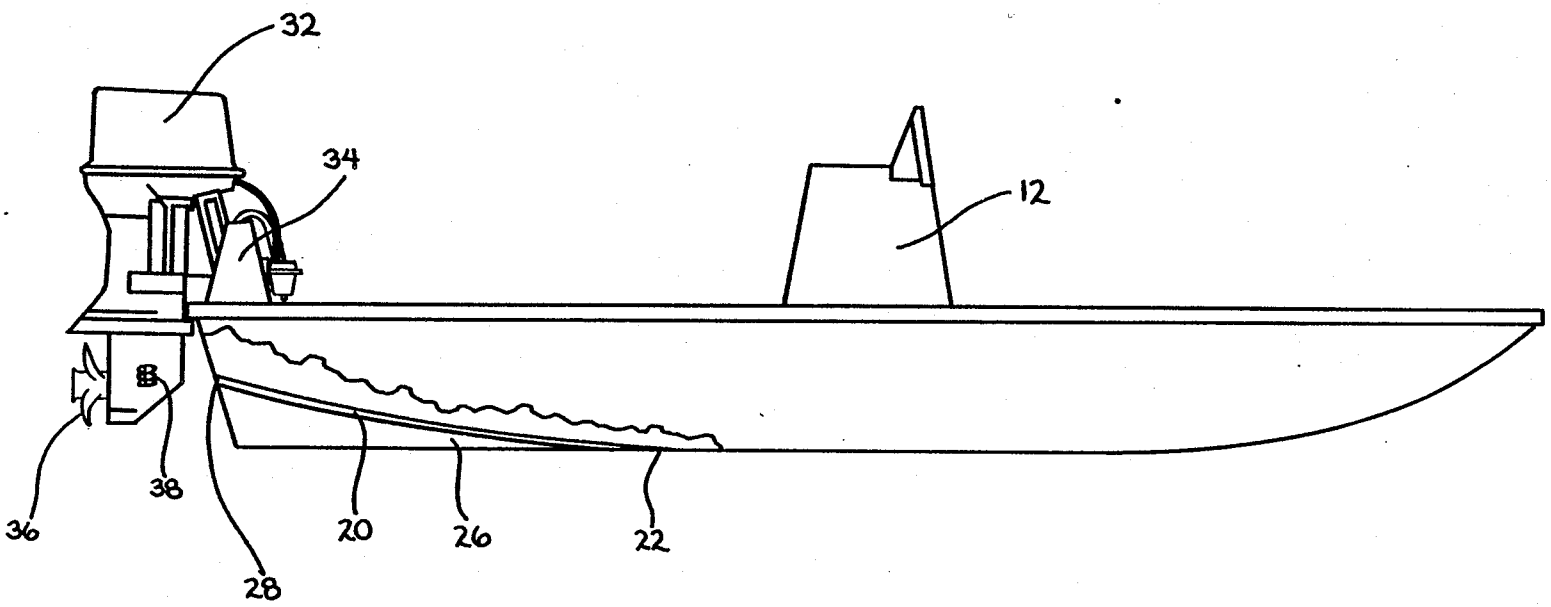
FIG. 2 is a partial section side view of the boat tunnel in a boat with a motor attached.

Turning now to FIG. 2, a side view of boat 12 is shown in partial sectional view illustrating convex tunnel 20 more clearly. Also shown is motor 32 attached to motor mount 34. Motor 32 has propeller 36 and water coolant intakes 38. Motor 32, motor mount 34, propeller 36, and water coolant intakes 38 are all known in the art and not discussed further herein. Nonetheless, motor 32 of the present invention has the ability to travel from a totally lowered position below the hull of a boat to a totally raised position above the hull of the boat as will be more fully described hereafter in FIG. 5.

Figure 3:
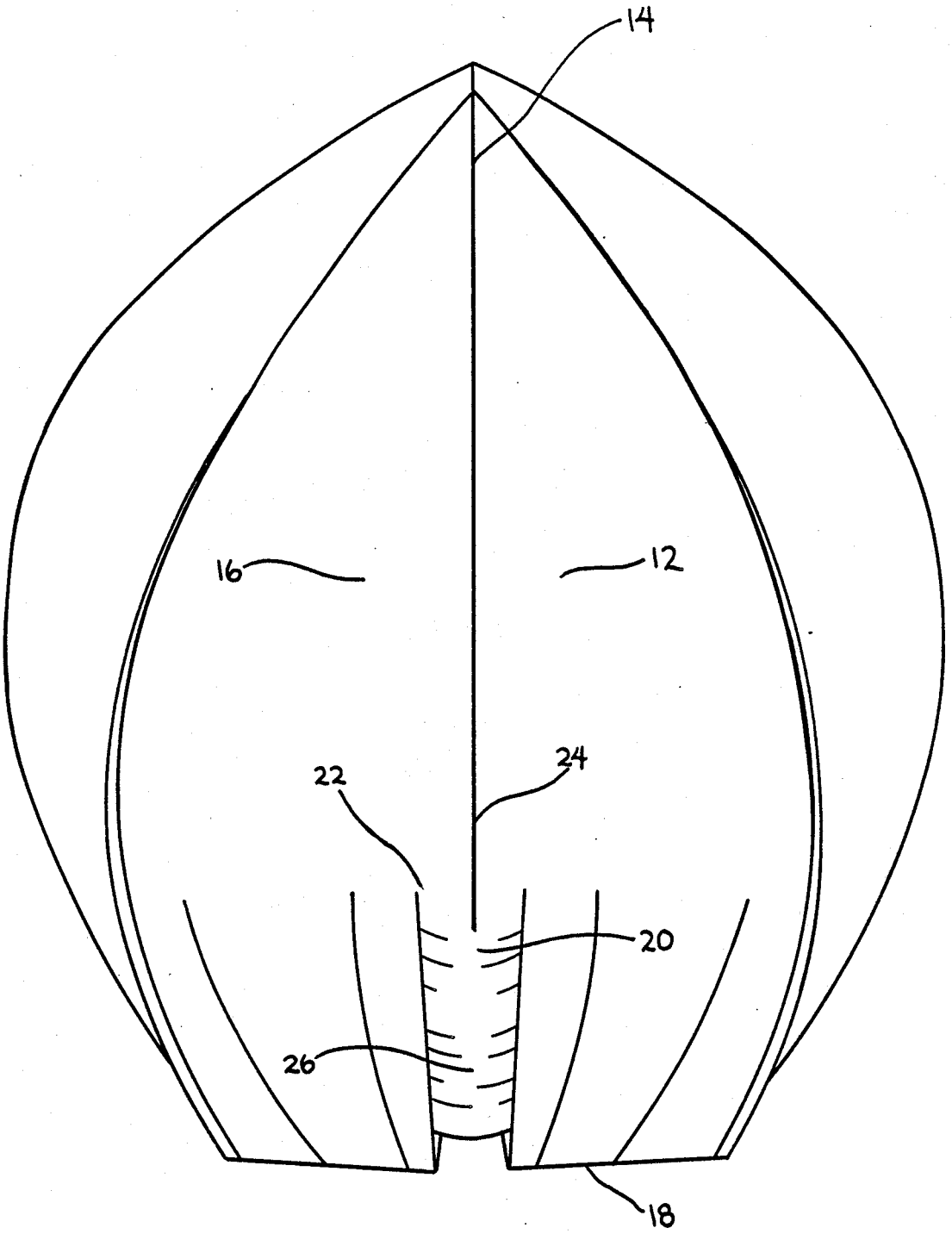
FIG. 3 is a view of the hull of the boat looking from the bow to the stern.
Figure 4:
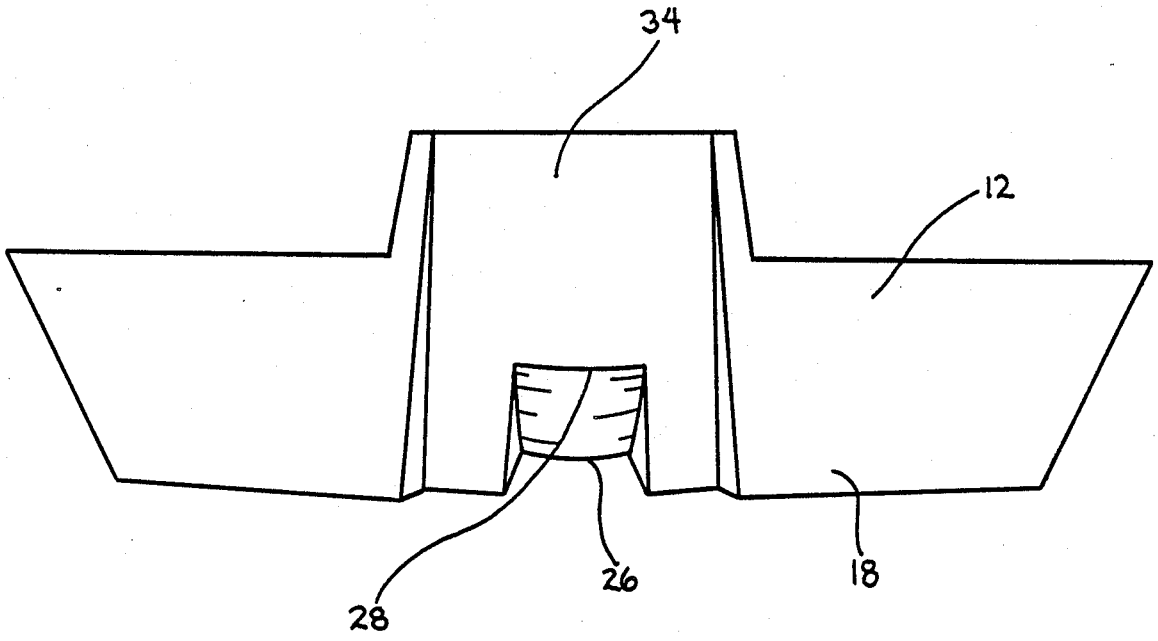
FIG. 4 is a stern view showing the place where the motor fits and the convex tunnel exiting the boat at its stern.

FIGS. 3 and 4 illustrate the convex tunnel 20 from different views. FIG. 3 illustrates convex tunnel 20 looking from the bow 14 of boat 12 toward the stern 18. FIG. 4 views the convex tunnel 20 from the stern 18 of boat 12. Here, motor mount 34 is clearly shown in the absence of motor 32.

Turning now to FIG. 5, the operation of boat tunnel system 10 is dislosed. FIG. 5*a* shows boat 12 at rest position 40. Water line 30 is clearly shown by the wavy line representing the water 42 within which the boat 12 floats. In rest position 40, motor 32 is in the fully extended or lowered position so that propeller 36 extends beneath the bottom of hull 16. This is the normal operating position for boats commonly known in the art.

Figure 5A:
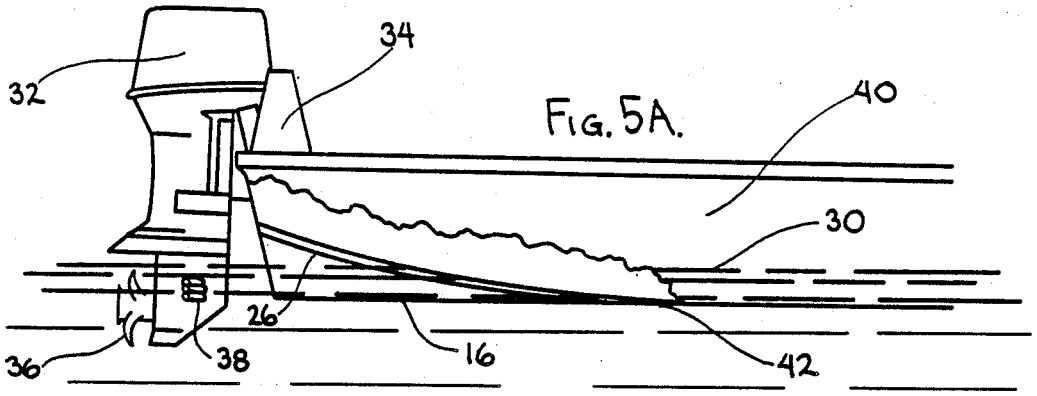
FIG. 5 cosists of partial side views of the boat tunnel system of the present invention showing the boat at rest in FIG. 5*a;* in moving slowly forward FIG. 5*b;* in moving faster forward and coming to plane while the motor with attached propeller is raised FIG. 5*c.
* and FIG. 5*d* is a view of the boat at plane with the motor raised, with attached propeller and water intakes, completely above the hull of the boat.
Figure 5B:
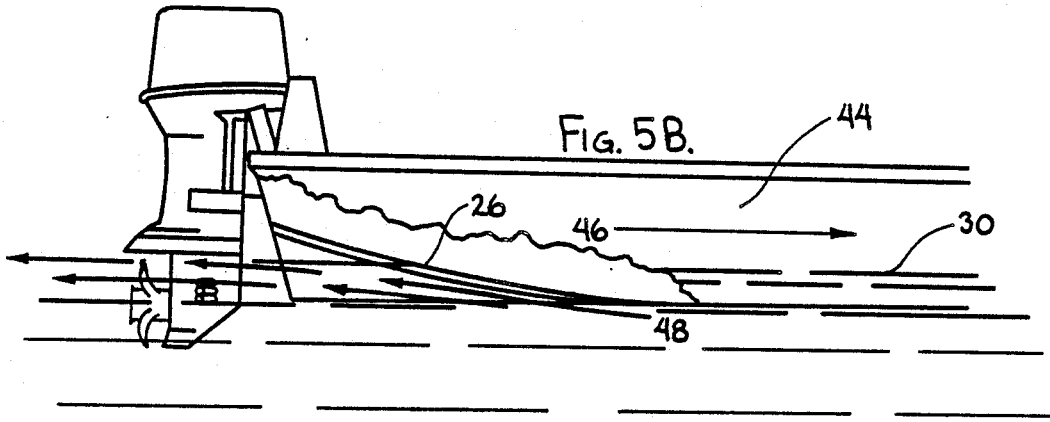

FIG. 5*b* shows boat 12 in slow ahead position 44. In slow ahead position 44, movement of the boat is in direction of arrow 46 causing water 42 to travel along convex tunnel 20 in the direction of arrows 48. As water 42 travels along convex tunnel 20, it adheres to the convex surface and is drawn, by the convex surface, along the tunnel until it exits rearward end 28 above water line 30 as illustrated by arrows 48. A solid stream of water 42 is then provided above the normal water line by means of convex tunnel 20, as illustrated in FIG. 5*b*.

Figure 5C:
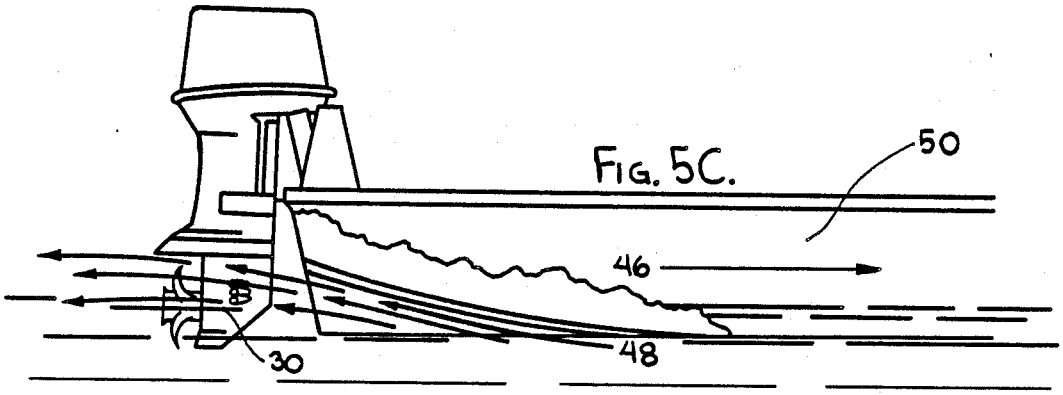

FIG. 5*c* illustrates boat 12 in a coming to plane position 50. The faster boat 12 moves through the water in the direction of arrow 46, the more water 42 is forced through convex tunnel 20 and the more water 42 exits rearward end 28 of convex tunnel 20 above water line 38. In fact, water 42 increases in height above the water line 30 the faster boat 12 moves through the water. As solid water 42 is provided above water line 30, motor 32 of the present invention may be raised to an intermediate position from its completely lowered position, shown in FIG. 5*a*. As illustrated in FIG. 5*c*, propeller 36 can be raised to a position which normally would be half in and half out of water line 30 but, because of convex tunnel 20, is fully within a solid stream of water 42. Importantly, water coolant intakes 38 also are within a solid stream of water 42 even though raised far above the normal water line 30 of a boat constructed as previously known in the art.

Figure 5D:
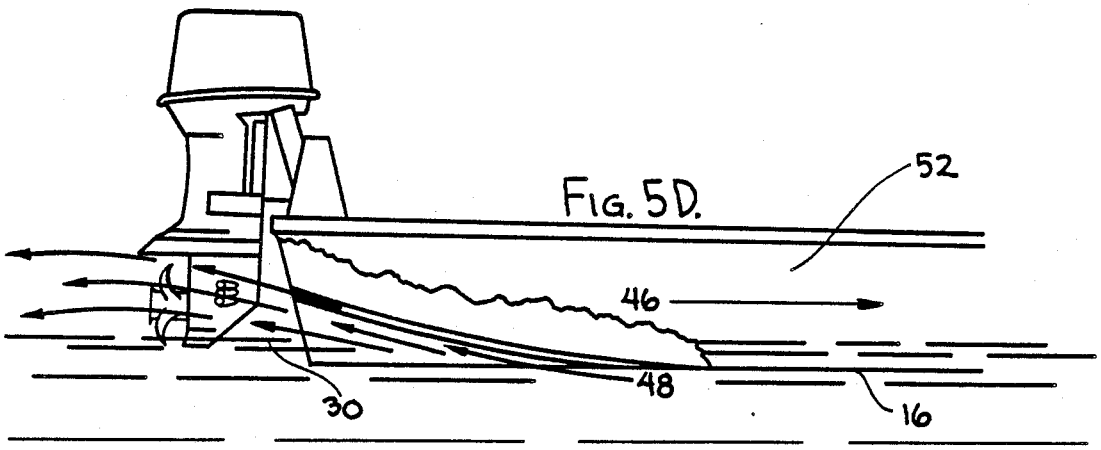

Referring now to FIG. 5*d*, boat 12 is in plane position 52. While boat 12 is in plane position 52, a solid stream of water 42 exits rearward end 28 of convex tunnel 20, far above water line 30. While in plane position 52, motor 32, propeller 36, and water intakes 38 are actually raised completely above the normal water line 30. In fact, as shown in FIG. 5*d*, propeller 36 and water intakes 38 can actually be raised above the bottom or hull of boat 12. As a result, while in plane position 52, the primary limitation of the depth of water within which boat 12 can operate is the draft of the boat itself.

In operation, by means of boat tunnel system 10, boat 12 includes a convex tunnel 20 with forward end 22 that commences at mid-point 24 of, and flush with, in the hull 16 of boat 12. Convex center section 26 arches away from hull 16 upwards until it terminates in rearward end 28 that exits stern 18 above water line 30.

The convex tunnel 20 construction is critical to the operation of boat tunnel system 10. In much the same way as the rounded side of a spoon is sucked into water flowing from a water faucet while the upper side of convex section of the spoon is repelled by the water from a faucet, convex tunnel 20 and convex center section 26 suck the water along the rounded surface of convex center section 26 instead of forcing it away from the boat as would be the case if center section 26 were concave instead of convex.

While boat 12 is in rest position 40 or moving extremely slowly, motor 32 is in the fully lowered or extended position so that propeller 36 and water coolant intakes 38 are below the normal water line 30 of water 42 on boat 12 as well as below hull 16. As boat 12 moves forward in direction of arrow 46, from slow ahead position 44 to coming to plane positio 50, water 42 is directed into convex tunnel 20 and adheres to the convex center section 26. Water 42 then exits rearward end 28 in stern 18 above water line 30. As boat 12 gains speed, water 42 exits higher and higher above water line 30. As a result, as speed is gained, motor 32 can be raised from a completely lowered position to intermediate positions, to, finally, a completely raised position, as illustrated in FIG. 5*d*. In the plane position 52, motor 32 with propeller 36, is raised completely above not only the original water line 30, but even above boat hull 16. Thus, the boat tunnel systems of the present invention has the important advantage of utilizing pre-existing motors to provide a boat that can travel in extremely shallow waters limited only by the draft of the boat to which the motor is attached and within which the boat tunnel system is provided.

While the present invention has been disclosed in connection with the preferred embodiment thereof, it should be understood that there may be other embodiments which fall within the spirit and scope of the invention as defined by the following claims.

What is claimed is:

1. A boat tunnel system comprising:

A. a boat with a hull, bow, and stern;

B. a convex tunnel formed in said hull exiting said stern above a water line of said boat so that as said boat travels through water, said water adheres to said convex tunnel as said tunnel exists said stern above said water line and flows upwardly above said water line as said water exits the tunnel at said stern; and C. a movable motor means, with a propeller, attached to said stern so that as said water exits said convex tunnel and flows upwardly therefrom, said propeller is raised within said upwardly flowing exiting water until said propeller is above said water line.

2. The boat tunnel system of claim 1 wherein said convex tunnel further comprises:

A. forward end commencing flush with said hull;

B. a convex center section curving away from sais hull; and

C. a rearward end terminating above said water line in said stern.

3. The boat tunnel of claim 2 wherein said movable motor further comprises:

A. a starting position with said propeller below said hull;

B. a plurality of mid-range positions as said boat travels faster and as said propeller is moved from below said hull to above said hull; and C. an above hull position wherein said propeller and water cooling intakes mounted on the motor means above the propeller gear housing are located in a solid water stream exiting said convex tunnel above said water line in said stern and above the bottom of the hull.

4. A boat tunnel system for shallow water operation comprising:

A. a boat with a hull, a bow, and stern;

B. a convex tunnel formed in said hull exiting said stern above a water line of said boat so that as said boat travels through water, said water adheres to said convex tunnel as said tunnel exits said stern above said water line and flows upwardly above said water line as said water exits the tunnel at said stern;

C. a forward end of said tunnel commencing at a mid-point and flush with said hull;

D. a convex center section of said tunnel curving away from said hull;

E. a rearward end of said tunnel terminating above said water line in said stern;

F. a movable motor means, with a propeller, attached to said stern so that as said water exits said convex tunnel and flows upwardly therefrom, said propeller is raised within said upwardly flowing exiting water until said propeller is above said water line;

G. a starting position with said propeller below said hull;

H. a plurality of mid-range positions as said boat travels faster and as said propeller is moved from below said hull to above said hull; and I. an above hull position wherein said propeller and water cooling intakes mounted on the motor means above a propeller gear housing are located in a solid water stream exiting said convex tunnel above said water line in said stern and above the bottom of the hull.

5. A boat tunnel method comprising the steps of:

A. providing a boat with a hull, bow, and stern;

B. constructing a convex tunnel formed in said hull exiting said stern above a water line of said boat so that as said boat travels through water, said water adheres to said convex tunnel as said tunnel exits said stern above said water line and flows upwardly above said water line as said water exits the tunnel at said stern; and C. attaching a movable motor means, with a propeller, to said stern so that as said propeller moves said boat through said water, said water exits said convex tunnel flowing upwardly, and said propeller is raised within said upwardly flowing exiting water until said propeller is above said water line.

6. The method of claim 5 wherein constructing said convex tunnel further comprises the steps of:

A. constructing a forward end commencing flush with said hull;

B. constructing a convex center section curving away from said hull; and

C. providing a rearward end terminating above said water line in said stern.

7. The method of claim 6 wherein attaching a movable motor means further comprises the steps of:

A. providing a starting position with said propeller below said hull;

B. providing a plurality of mid-range positions as said boat travels faster and as said propeller is moved from below said hull to above said hull; and C. providing an above hull position wherein said propeller and water cooling intakes mounted on the motor means above a propeller gear housing are located in a solid water stream exiting said convex tunnel above said water line in said stern so that said boat is capable of traveling in shallow water with said propeller above said hull.

8. A boat tunnel method for shallow water operation comprising the steps of:

A. providing a boat with a hull, bow, and stern;

B. constructing a convex tunnel formed in said hull exiting said stern above a water line of said boat so that as said boat travels through water, said water adheres to said convex tunnel as said tunnel exits said stern above said water line and flows upwardly above said water line as said water exits the tunnel at said stern;

C. constructing a forward end of said tunnel commencing at a mid-point of and flush with said hull;

D. convex center section of said tunnel curving away from said hull;

E. providing a rearward end of said tunnel terminating above said water line in said stern;

F. attaching a movable motor means with a propeller, to said stern so that as said propeller moves said boat through said water, said water exits said convex tunnel flowing upwardly, and said propeller is raised within said upwardly flowing exiting water until said propeller is above said water line;

G. providing a starting position with said propeller below said hull;

H. providing a plurality of mid-range positions as said boat travels faster and as said propeller is moved from below said hull to above said hull; and I. providing an above hull position wherein said propeller and water cooling intakes mounted on the motor means above a propeller gear housing are located in a solid water stream exiting said convex tunnel above said water line in said stern so that said boat is capable of traveling in shallow water with said propeller above said hull.

* * * * *